US006406324B1

(12) United States Patent
Duesterhoeft et al.

(10) Patent No.: US 6,406,324 B1
(45) Date of Patent: Jun. 18, 2002

(54) INSULATION DISPLACEMENT CONNECTOR TERMINAL BLOCK

(75) Inventors: Scott Stephen Duesterhoeft, Etters; William Gray Lenker, Marysville, both of PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/805,272

(22) Filed: Mar. 13, 2001

(51) Int. Cl.[7] ..... H01R 4/24
(52) U.S. Cl. ..... 439/409
(58) Field of Search ..... 439/409, 404, 439/406

(56) References Cited

U.S. PATENT DOCUMENTS 4,541,679 A * 9/1985 Fiedler et al. ..... 439/395
5,785,548 A * 7/1998 Capper et al. ..... 439/409
6,089,902 A * 7/2000 Daoud ..... 439/409
6,152,760 A * 11/2000 Reeser ..... 439/409
6,159,036 A 12/2000 Daoud ..... 439/409
6,165,003 A 12/2000 Bigotto ..... 439/406
6,168,478 B1 1/2001 Daoud ..... 439/746
6,254,421 B1 * 7/2001 Denovich et al. ..... 439/409

* cited by examiner

*Primary Examiner*—Tulsidas Patel

(57) ABSTRACT

An insulation displacement connector ("IDC") and non-IDC terminal block having multiple pivoting wire stuffer elements positioned side-by-side such that each wire stuffer element is retained in its lateral position and may be held in an open position are disclosed. The wire stuffer elements are restricted in the lateral degree of freedom by at least one side retaining structure formed in the terminal block housing. The side retaining structure couples with each wire stuffer element to maintain the wire stuffer in its lateral position within the terminal block housing. A detent structure may also be formed on the wire stuffer element to interact with the terminal block housing such that the wire stuffer element will remain in an open position after being pivoted into that position. Because the wire stuffer elements may be positioned directly side by side, without the need for internal side retaining walls, the overall dimension of the IDC terminal block may be reduced without sacrificing ease of assembly and ease of use of the IDC terminal block.

16 Claims, 3 Drawing Sheets

INSULATION DISPLACEMENT CONNECTOR TERMINAL BLOCK

This invention generally relates to electrical connectors used in the telecommunications and cable communications fields. More particularly, the present invention relates to an inventive insulation displacement connector ("IDC") terminal block having a plurality of pivoting wire stuffer elements placed directly side-by-side within the IDC terminal block and having side retaining elements incorporated in the terminal block such that the lateral movement of the wire stuffer elements is restricted. Because the wire stuffer elements are maintained within the IDC terminal block and lateral movement of the wire stuffer elements is restricted, there is no need to fabricate side walls between each of the wire stuffer elements to maintain the lateral position of the wire stuffer elements. Because internal sidewalls are not necessary in the inventive connector terminal block, the overall width of the terminal block may be reduced, thereby allowing the dimensions of the IDC terminal block to be reduced.

BACKGROUND DESCRIPTION

With the decreasing size of electronic devices used in most all fields, there is a continuing demand for smaller sized electrical components used in these electronic devices. This is especially so in the telecommunications field with the demand for mobile, lightweight and smaller sized devices. Similarly, in the field of cable communications, smaller sized electronic devices and the related connectors are in demand. For example, the household use of cable communications, both for television and computer connections, is one area where the need for smaller sized and reliable connectors is rapidly expanding.

In the telecommunications field, and more specifically in the cable communications field, IDCs are used to quickly and reliably connect wires to a printed circuit board, a junction or distribution box or other devices. The IDC allows the user to connect the wire without the need for first removing the insulation from the wire end. That is, the IDC cuts through the insulation, when the wire is seated in the IDC, to make electrical connection. This ease of making wire connections, especially out in the field, makes the IDC a very useful component.

Example prior art IDCs include those disclosed in U.S. Pat. No. 6,168,478 B1, for a Snap Type Retention Mechanism For Connector Terminals issued to Daoud; U.S. Pat. No. 6,159,036, for a Locking Latch Mechanism For An Insulation Displacement Connector, also issued to Daoud; and U.S. Pat. No. 6,165,003, for an Electrical Connector With Variable Thickness Insulation-Piercing Contact Member issued to Bigotto. As shown and described in each of these patents, the IDC generally has a conducting terminal with a pair of beams such that when the wire and insulation is forced between the beams and the beams' edges cut through the wire insulation and make electrical contact with the wire.

Another example prior art IDC is shown in FIGS. 1(*a*), 1(*b*), and 1(*c*). The device shown is a four pair pivot connector assembly manufactured by the assignee of the present invention, Tyco Electronics. As shown, this device is an IDC having four pivoting wire stuffer elements or wire stuffers 20. The wire stuffers 20 each have two wire slots 21 and are pivotable over the IDC terminal beams 41. With the wire stuffer 20 in an open position, the wire (not shown) may be placed into the wire slot 21. When the wire stuffer 20 is then forced into the closed position, with the wire in the wire stuffer slot 21, the terminal beams 41 cut through the wire insulation and the wire is electrically connected to the terminal. The wire slot 21 diameter is fabricated to accept a limited range of wire sizes. In the telecommunications field, and for the prior art IDC shown in FIGS. 1(*a*), 1(*b*), and 1(*c*), the wire gauge may be between 22 AWG and 26 AWG.

While IDCs are very useful, multiple pivoting packages such as shown in FIGS. 1(*a*) through 1(*c*), are limited in the lateral dimension, in part, by the need for sidewall structure 25 between each wire stuffer 20. The sidewall structure 25 is necessary to maintain each wire stuffer 20 in its lateral position and keep it aligned with the respective terminal beams 41. Without the separating sidewall structure 25, the individual wire stuffers 20 could freely move side to side and become misaligned within the housing 30.

Moreover, in a typical configuration with the IDC assembled on a circuit board (not shown) and positioned in an orientation as shown in FIG. 1(*a*), the pivotable wire stuffers 20 tend to rotate into a closed position due to gravity, even after being opened. This tendency to revert to a closed position makes efficient use of the IDC more difficult because the wire stuffer 20 must be opened and held open or in an up position by some external mechanism while the wire to be connected to the IDC is located and placed into the wire stuffer slot 21. Ease of use of this type of IDC would be greatly enhanced if the pivoting wire stuffers 20 would remain in an open position, after being opened, until it was purposely closed.

Accordingly, there remains a need for an IDC terminal block having multiple side-by-side pivotable wire stuffers that has certain features making assembly and use of the terminal block easier and more efficient. Such features include that the wire stuffers are maintained in a lateral position within the terminal block housing without the need for sidewall structure between each wire stuffer, and that the pivoting wire stuffers, once opened, remain in an open position until each is purposely closed. An IDC terminal block with these features would result in improved ease of assembly and ease of use. Moreover, because the need for internal sidewall structure is absent, the overall dimension of the IDC terminal block may be reduced.

SUMMARY OF THE INVENTION

In view of the shortcomings of the prior art, it is an object of the present invention to provide an IDC or non-IDC terminal block having multiple side-by-side pivotable wire stuffer elements that are maintained in position in the terminal block housing without the need for internal side wall housing structure. An additional object of the present invention is to provide an IDC or non-IDC terminal block such that the pivoting wire stuffer elements, when pivoted into an open position, remain open until each is purposely closed.

To achieve this and other objects, and in view of its purposes, the present invention provides an insulation displacement connector terminal block, comprising a body section; at least two electrical contacts maintained within the body section, the electrical contacts each being formed to displace insulation from and make electrical contact with a wire; at least two wire holding sections pivotable within the body section, the wire holding sections positioned adjacent to each other within the body section; and a lateral retaining element formed within the body section, the lateral retaining element cooperating with each wire holding section wherein each wire holding section is laterally maintained within the body section.

It is a further object of the present invention to provide an insulation displacement connector terminal block, comprising a body section; at least two electrical contacts maintained within the body section, the electrical contacts each being formed to displace insulation from and make electrical contact with a wire; at least two wire holding sections pivotable within the body section, said wire holding sections positioned adjacent to each other within the body section; and at least two lateral retaining elements formed within the body section, the lateral retaining elements cooperating with the wire holding sections wherein the wire holding sections are laterally maintained within the body section.

It is a further object of the present invention to provide an insulation displacement connector terminal block further comprising a pivot latch formed on each of the at least two wire holding sections, the pivot latch cooperating with the body section wherein the wire holding sections are latchable in an open position.

It is a further object of the present invention to provide an insulation displacement connector terminal block wherein the connector terminal block is sized to accept wire gauge approximately within the range of 16 AWG to 28 AWG.

It is still a further object of the present invention to provide an insulation displacement connector terminal block wherein each of the electrical contacts has a first end and second end, and each electrical contact further comprises an approximately orthogonal bend located approximately equal distance between the first and second ends.

These and other aspects of the present invention are set forth below with reference to the drawings and the detailed description of certain preferred embodiments. It is to be understood that both the foregoing general description and the following detailed description are exemplary, and are not intended to be or should be considered restrictive of the invention.

BRIEF DESCRIPTION OF THE DRAWINGS

The invention is best understood from the following detailed description when read in connection with the accompanying drawings. It is emphasized that, according to common practice, the various features of the drawing are not to scale. On the contrary, the dimensions of the various features are arbitrarily expanded or reduced for clarity. Included in the drawings are the following Figures:

FIG. 1(*b*) is a left side cutaway view of a prior art pivoting IDC connector, specifically showing view A—A from FIG. 1(*a*);

FIG. 1(*c*) is a right side view of a prior art pivoting IDC connector;

DETAILED DESCRIPTION OF PREFERRED EMBODIMENTS

The present invention is directed to an insulation displacement connector or IDC terminal block having more than one pivotable& wire stuffer within the IDC terminal block. More particularly, the present invention is to an improved structural geometry of the IDC terminal block housing that couples with the pivotable wire stuffer elements such that the need for sidewall structure between each wire stuffer to maintain the lateral position of the wire stuffers is eliminated. The present invention also includes an improved structure of the IDC housing and wire stuffer elements such that the wire stuffer elements remain in an open position, after being opened, until they are purposely closed. The present invention also is equally applicable to terminal block housings that are not insulation displacement connectors.

Figure 2:
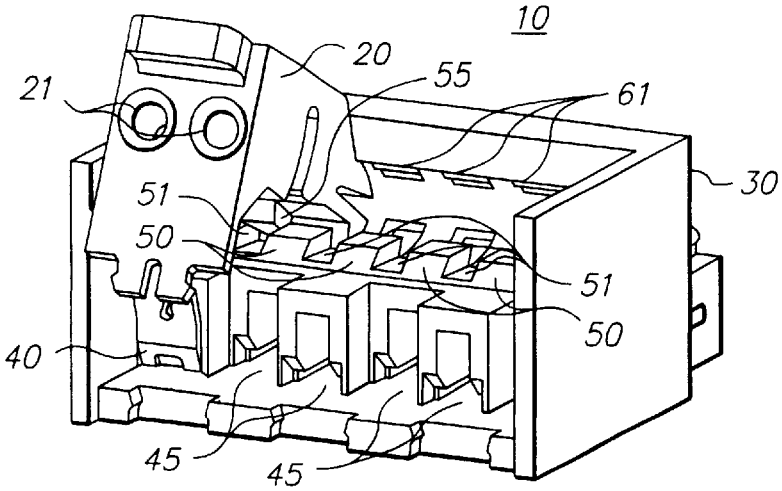
FIG. 2 is a front perspective view of an exemplary embodiment of the present inventive IDC terminal block with pivoting wire stuffers.

As shown in FIG. 2, a preferred embodiment of the inventive IDC terminal block 10, has an IDC terminal block housing 30 in which at least one terminal 40 is rigidly seated. While the FIG. 2 illustration is shown with only one terminal 40 installed in the terminal block housing 30, when fully assembled, additional terminals 40 are installed in the housing 30 in each of the four terminal openings 45. The FIG. 2 illustration of the IDC terminal block is shown in an incomplete assembly for ease of disclosure and description of the structure.

Figure 3:
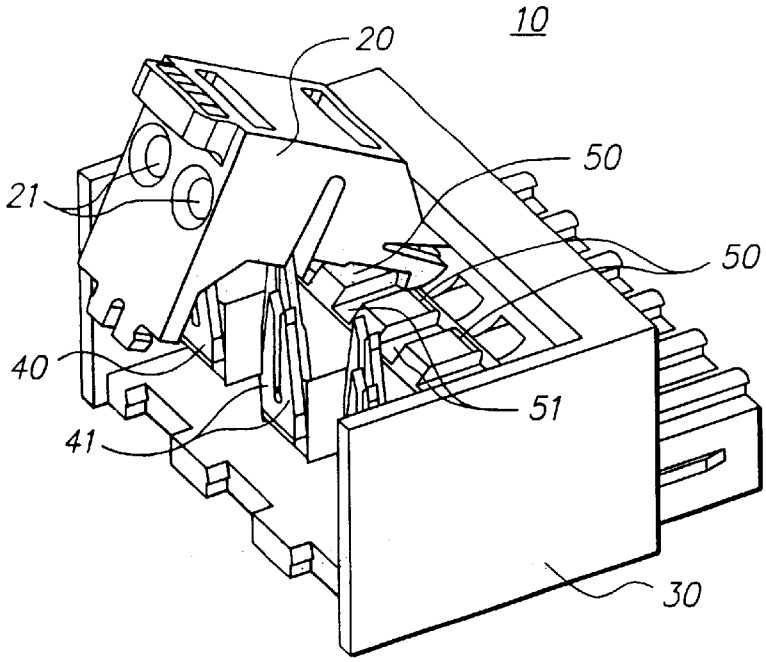
FIG. 3 is a top perspective view of an exemplary embodiment of the present inventive IDC terminal block with pivoting wire stuffers.

The inventive IDC terminal block 10 also has at least two wire stuffers 20. Similar to the terminals 40, only one wire stuffer 20 is shown in FIG. 2 to permit an unobstructed internal view of the housing 30 for illustration purposes. FIG. 3 provides a top perspective view of the same preferred embodiment of the inventive IDC terminal, and shows five terminals 40 installed and seated in each terminal opening 45. In a fully assembled state, the IDC terminal block preferred embodiment shown in FIGS. 2, 3, and 4 has three wire stuffers 20 and six terminals 40. In the embodiment shown, each wire stuffer is aligned with two terminals 40. The wire stuffers 20 each have at least one wire slot 21. The wire slot 21 is formed within the wire stuffer 20 and is positioned to align a wire within a respective terminal 40 and in between the terminal beams 41. The wire size or wire gauge that is capable of being accommodated by the inventive IDC terminal block extends from 16 AWG to 28 AWG.

Figure 1A:
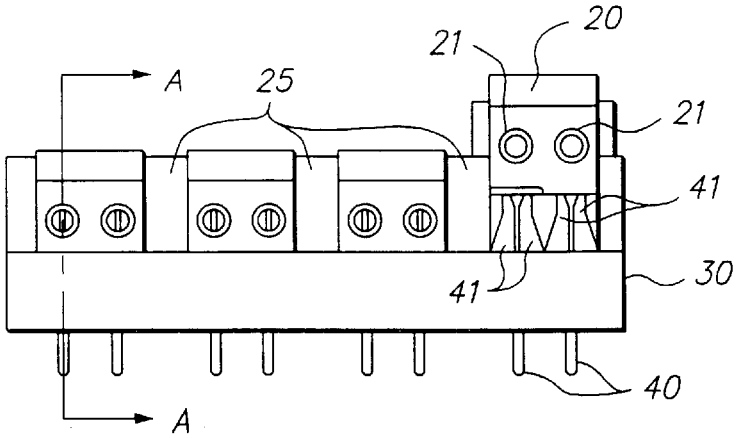
FIG. 1A (PRIOR ART)
FIG. 1(*a*) is a front view of a prior art pivoting IDC connector.
Figure 1B:
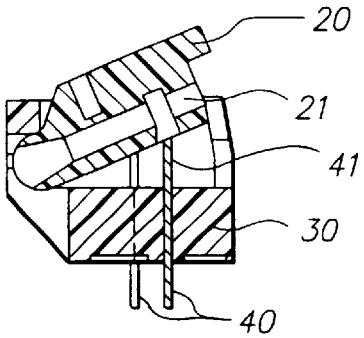
FIG. 1B (PRIOR ART)
Figure 1C:
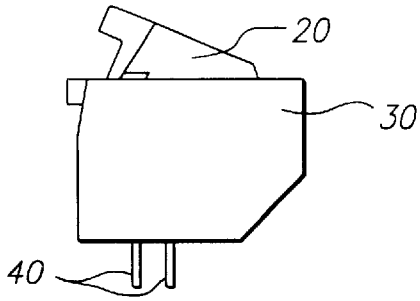
FIG. 1C (PRIOR ART)

The inventive IDC terminal block 10, as shown in one preferred embodiment in FIG. 2, does not have internal sidewall structure 25 between each wire stuffer 20 as in the FIG. 1(*a*) prior art devices. Even without sidewall structure, the individual wire stuffers 20 seated in the terminal block housing 30 are still retained in their respective lateral positions. The wire stuffers 20 are laterally held in position due to the structural coupling of side retaining elements 50 formed in the housing 30 with the wire stuffers 20.

In one preferred embodiment shown in FIG. 2, six side retaining elements 50 are formed in the terminal block housing 30. The six side retaining elements, as shown in the FIG. 2 preferred embodiment, form five cavities 51. As shown, the side retaining element 50 couples with a wire stuffer 20, and specifically with a side block element 55 formed in each wire stuffer 20 to restrict the lateral degree of freedom of the wire stuffer 20. The FIG. 2 front perspective view shows how, in this embodiment, the side block element 55 fits into a cavity 51 formed by the side retaining elements.

Figure 4:
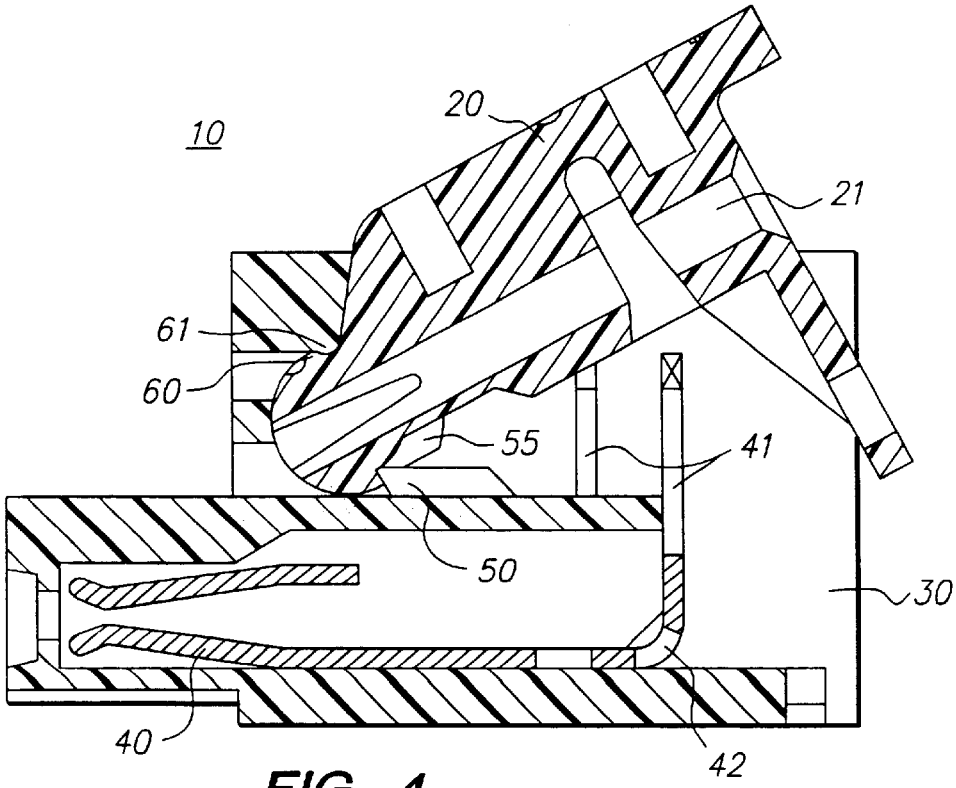
FIG. 4 is a side internal view of an exemplary embodiment of the present inventive IDC terminal block with pivoting wire stuffers.

As more particularly shown in the FIG. 4 side cut away view of a preferred embodiment of the inventive IDC terminal block, the lateral movement of the wire stuffer 20 is restricted because the side retaining element 50 is adjacent to and in direct contact with the wire stuffer 20. More specifically, as shown in the FIG. 4 internal view, the upper left section of the housing side retaining element 50 is in contact with wire stuffer side block element 55 with the wire stuffer side block fitting into a cavity 51. As the wire stuffer 20 is pivoted down into the closed position, more of the retaining element 50 is in contact with the side block element 55 because the side block element 55 fits into its respective cavity 51. In either the fully open or fully closed position, the lateral degree of freedom of the wire stuffer is restricted because the housing side retaining element 50 is laterally in contact with the wire stuffer 20 side block element 55.

While the wire stuffers 20 are prevented from lateral motion because the side retaining elements 50 are in direct contact and coupled with the wire stuffer 20 side block element 55, the wire stuffer 20 pivoting degree of freedom is not restricted in any manner. This aspect of the present invention, restricting the wire stuffer lateral degree of freedom, and allowing free pivoting motion, is important to ensure proper operation of the device. It also enhances ease of assembly and use of the IDC terminal block while allowing fabrication of reduced size devices.

In another preferred embodiment of the inventive IDC terminal block, not shown, the terminal block housing 10 side retaining element may be formed as a single structure instead of individual elements 50 as shown in FIG. 2. This embodiment with a single side retaining structure may be more cost efficient to fabricate and produce, although either embodiment may be equally functional in restricting the lateral movement of the individual wire stuffers 20 within the terminal block housing 30.

Although the side retaining elements 50 are shown as a box shape, they may also be other shapes and be equally effective. For example, dome shaped or other geometry may also be used so long as proper coupling occurs between the side retaining elements 50 and the wire stuffer 20 side block element 55.

The preferred embodiment of the inventive IDC terminal block 10 shown in FIGS. 2, 3 and 4 discloses the terminals 40 having a right angle bend 42 such that the terminal block 10 may be installed into a board or junction box (not shown) through the back of the terminal block 10. In an equally effective preferred embodiment, the IDC terminal block 10 may have straight terminals 40 such that electrical installation of the terminal block 10 would be through the bottom of the terminal block 10. Different requirements for varied applications and installations often dictate different configurations. The inventive IDC terminal block may be configured to meet these different requirements through use of different terminal configurations.

As also shown in FIG. 4, the wire stuffer 20 is formed with a detent 60 that couples with a lip 61 formed in the terminal block housing 30. When the wire stuffer 20 is lifted into the open position, as shown in FIG. 4, the detent 60 passes over and engages with the housing lip 61. The preferred configuration for the housing lip 61, shown in FIG. 4, is further shown in FIG. 2 on the top edge of the terminal block housing 30. Once the detent 60 has engaged the housing lip 61, the wire stuffer will remain in its open position until it is purposefully pushed down into the closed position, thereby releasing the detent 60 from the housing lip 61.

Similar to the above described side retaining element 50, the housing lip 61 need not be a cylinder shape, but may be fabricated in other shapes. For example, the housing lip 61 could be spherical in shape or another geometry, such as a section of an octagon. In a preferred embodiment of the housing lip 61 having a spherical shape, the position of the housing lip 61 on the housing 30 need not be at the top of the housing 30 as shown in FIG. 2. That is, the housing lip 61 may be positioned at another location within the housing 30, so long as the wire stuffer 20 detent 60 appropriately couples with and engages the housing lip 61.

Figure 5:
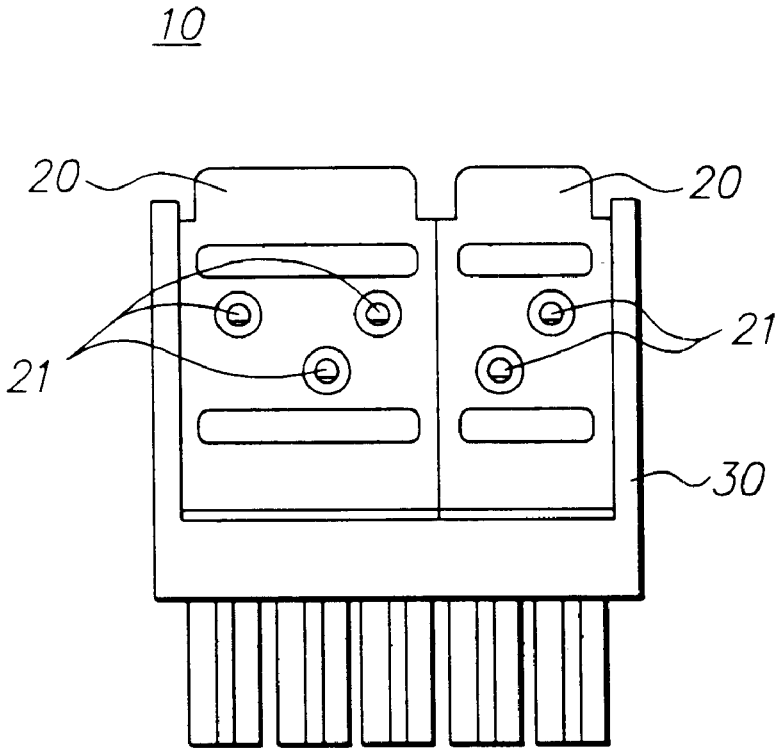
FIG. 5 is a top view of an exemplary embodiment of the present inventive IDC terminal block with pivoting wire stuffers of different sizes and accommodating a non uniform number of wires.

The FIG. 2 through 4 preferred embodiments show uniform sized wire stuffers 20, each having the same number of wire slots 21 in each wire stuffer. For different applications, different IDC terminal block configurations may be needed. As shown in FIG. 5 for example, non uniform wire stuffers 20 may be necessary for specific wiring applications. The preferred embodiment shown in FIG. 5 has one wire stuffer 20 with three wire slots 20 and an adjacent wire stuffer 20 having two wire slots 20. Obviously varied configurations of the inventive IDC terminal block may be fabricated to include two or more wire stuffers 20 being coupled in the housing 30, and a varied number of wire slots being formed in each wire stuffer 20.

Although the invention has been described and shown with reference to exemplary embodiments, it is not limited thereto. For example, as described, the side retaining elements 50 may be formed in a variety of shapes and sizes and be equally functional. Similarly, the number of wire stuffers 20 and wire slots 21 formed in each wire stuffer may also be adjusted to accommodate the needs of particular applications. Moreover, the inventive terminal block housing and wire stuffers may also be components of a non-insulation displacement connector. Accordingly, it is intended to be and understood that the following claims should be construed to include other variants and embodiments of the invention which may be made by those skilled in the art as being within the true spirit and scope of the present invention.

What is claimed is:

1. An insulation displacement connector terminal block, comprising:

a body section;

at least two electrical contacts maintained within the body section, said electrical contacts each being formed to displace insulation from and make electrical contact with a wire;

least two wire holding sections pivotable within the body section, said wire holding sections positioned directly adjacent to each other within the body section, said wire holding sections each further being pivotable over at least one electrical contact; and a lateral retaining element formed within the body section, said lateral retaining element cooperating with each wire holding section wherein each wire holding section is laterally maintained within the body section.

2. A connector terminal block, comprising:

a body section;

at least two electrical contacts maintained within the body section, said electrical contacts each being formed to make electrical contact with a wire;

at least two wire holding sections pivotable within the body section, said wire holding sections positioned directly adjacent to each other within the body section, said wire holding sections each further being pivotable over at least one electrical contact; and at least two lateral retaining elements formed within the body section, each said lateral retaining element cooperating with one wire holding section wherein each wire holding section is laterally maintained within the body section.

3. The connector terminal block according to claim 2, wherein the connector terminal block is an insulation displacement connector terminal block, and further wherein the at least two electrical contacts maintained within the body section are each formed to displace insulation from and make electrical contact with the wire.

4. The insulation displacement connector terminal block according to claim 1, further comprising a pivot latch formed on each of the at least two wire holding sections, said pivot latch cooperating with the body section wherein the wire holding sections are latchable in an open position.

5. The insulation displacement connector terminal block according to claim 1, wherein each of the electrical contacts has a first end and second end, and each electrical contact further comprises an approximately orthogonal bend located approximately equal distance between said first and second ends.

6. The insulation displacement connector terminal block according to claim 1, wherein three wire holding sections are pivotable within the body section, further wherein six electrical contacts are rigidly maintained in the body section such that two electrical contacts communicate with each of the three wire holding sections.

7. The insulation displacement connector terminal block according to claim 1, wherein the connector terminal block is sized to accept wire gauge approximately within the range of 16 AWG to 28 AWG.

8. An insulation displacement connector terminal block, comprising:

a body section;

six electrical contacts rigidly maintained within the body section, said electrical contacts each being formed to displace insulation from and make electrical contact with a wire;

three wire holding sections pivotable within the body section wherein each wire holding section is couplable with two electrical contacts, said wire holding sections positioned directly adjacent to each other within the body section, said wire holding sections each also having two openings in which a wire may be placed, wherein when a wire holding section, with a wire placed within each opening, is pivoted over the electrical contacts, the wire insulation is displaced and the wire is electrically connected with the electrical contact; and three lateral retaining elements formed within the body section, said lateral retaining elements each cooperating with one wire holding section wherein each wire holding section is laterally maintained within the body section.

9. The insulation displacement connector terminal block according to claim 8, further comprising a pivot latch formed on each of the three wire holding sections, said pivot latch cooperating with the body section wherein the wire holding sections are latchable in an open position.

10. The insulation displacement connector terminal block according to claim 8, wherein each of the six electrical contacts has a first end and second end, and each of the six electrical contacts further comprise an approximately orthogonal bend located approximately equal distance between said first and second ends.

11. The insulation displacement connector terminal block according to claim 8, wherein the wire opening is sized to accept wire gauge approximately within the range of 16 AWG to 28 AWG.

12. An insulation displacement connector terminal block, comprising:

a housing having a plurality of first lateral retaining members formed within the housing;

at least two electrical contacts rigidly maintained within the housing, said electrical contacts each being formed to displace insulation from and make electrical contact with a wire;

at least two wire stuffers pivotable within the housing, said wire stuffers positioned directly adjacent to one another and each pivotable over at least one electrical contact; and a second lateral retaining member formed on each of the wire stuffers, wherein each of the first lateral retaining members couple with at least one of said second lateral retaining members such that the wire stuffers are laterally maintained within the housing.

13. The insulation displacement connector terminal block according to claim 12, wherein the connector terminal block is sized to accept wire gauge approximately within the range of 16 AWG to 28 AWG.

14. The insulation displacement connector terminal block according to claim 12, wherein each of the electrical contacts has a first end and second end, and each electrical contact further comprises an approximately orthogonal bend located approximately equal distance between said first and second ends.

15. The insulation displacement connector terminal block according to claim 12, wherein the first lateral retaining members are block shaped and the second lateral retaining members are square edges cut into each wire stuffer.

16. The insulation displacement connector terminal block according to claim 12, wherein the first lateral retaining members are dome shaped and the second lateral retaining members are concave shaped indents formed in each wire stuffer.

* * * * *